US008997979B2

(12) United States Patent
Ghini et al.

(10) Patent No.: US 8,997,979 B2
(45) Date of Patent: Apr. 7, 2015

(54) SLIDE-OPEN PACKAGE OF TOBACCO ARTICLES

(75) Inventors: Marco Ghini, Monte San Pietro (IT); Andrea Biondi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 226 days.

(21) Appl. No.: 13/703,155

(22) PCT Filed: Jun. 11, 2011

(86) PCT No.: PCT/IB2011/001305
§ 371 (c)(1),
(2), (4) Date: Feb. 12, 2013

(87) PCT Pub. No.: WO2011/154822
PCT Pub. Date: Dec. 15, 2011

(65) Prior Publication Data

US 2013/0140201 A1 Jun. 6, 2013

(30) Foreign Application Priority Data

Jun. 11, 2010 (IT) ..... BO2010A0368

(51) Int. Cl.
*B65D 85/10* (2006.01)
*A24F 15/00* (2006.01)
*B65D 5/38* (2006.01)

(52) U.S. Cl.
CPC . *A24F 15/00* (2013.01); *B65D 5/38* (2013.01); *B65D 85/1054* (2013.01); *B65D 2215/02* (2013.01)

(58) Field of Classification Search
USPC ..... 206/267, 231, 265, 268, 271, 273, 261; 220/345.3, 345.2
See application file for complete search history.

(56) References Cited

U.S. PATENT DOCUMENTS

| | | | | |
|---|---|---|---|---|
| 4,534,463 | A | 8/1985 | Bouchard | |
| 4,559,758 | A | 12/1985 | Gamberini | |
| 4,646,960 | A * | 3/1987 | Challand | 206/259 |
| 5,080,227 | A | 1/1992 | Focke | |
| 6,837,369 | B2 * | 1/2005 | Amos | 206/273 |
| 8,418,845 | B2 * | 4/2013 | Tawada et al. | 206/267 |
| 2007/0278115 | A1 * | 12/2007 | Ghini et al. | 206/248 |
| 2009/0038966 | A1 * | 2/2009 | Ghini et al. | 206/268 |
| 2009/0045084 | A1 * | 2/2009 | Roila et al. | 206/268 |

* cited by examiner

FOREIGN PATENT DOCUMENTS

| | | | |
|---|---|---|---|
| DE | 92 10 112 | U1 | 11/1992 |
| IT | 1169163 | B | 5/1987 |
| WO | WO-2006/021581 | A1 | 3/2006 |

OTHER PUBLICATIONS

International Search Report in international application No. PCT/IB2011/001305, Nov. 7, 2010.

*Primary Examiner* — David Fidei
(74) *Attorney, Agent, or Firm* — Marshall, Gerstein & Borun LLP

(57) ABSTRACT

A package of tobacco articles, having an inner container containing a group of tobacco articles; an outer container which houses the inner container in such a manner as to allow the inner container to slide, with respect to the outer container, between a closed position, in which the inner container is inserted inside the outer container, and an open position, in which the inner container is partly extracted from the outer container; and at least one lock member which, in releasable manner by user action from the outside, prevents the inner container in the closed position from sliding with respect to the outer container.

21 Claims, 10 Drawing Sheets

SLIDE-OPEN PACKAGE OF TOBACCO ARTICLES

CROSS-REFERENCE TO RELATED APPLICATIONS

This is the U.S. national phase of International Application No. PCT/IB2011/001305, filed Jun. 11, 2011, which claims the benefit of Italian Patent Application No. BO2010A000368, filed Jun. 11, 2010.

TECHNICAL FIELD

The present invention relates to a slide-open package of tobacco articles.

In the following description, reference is made, for the sake of simplicity, to a slide-open packet of cigarettes, purely by way of a non-limiting example.

BACKGROUND ART

Rigid, hinged-lid packets of cigarettes are currently the most widely marketed, by being easy to make, easy and practical to use, and providing good protection of the cigarettes inside.

In addition to hinged-lid types, rigid slide-open packets of cigarettes are also now available, comprising two partly detachable containers inserted one inside the other, i.e. an inner container housing a foil-wrapped group of cigarettes, and itself housed inside an outer container to slide, with respect to the outer container, between a closed position, in which the inner container is inserted inside the outer container, and an open position, in which the inner container is partly expelled from the outer container. The inner container may be either slid straight or swung with respect to the outer container, by rotating the two containers about a connecting hinge.

A number of embodiments of rigid, straight slide-open packets of cigarettes are described in FR2499947A1, U.S. Pat. No. 4,534,463A1, U.S. Pat. No. 5,080,227A1 and IT1169163B. One embodiment of a rigid, swing-open packet of cigarettes is described in WO2006021581.

One drawback of rigid, slide-open packets of cigarettes is their tendency, in some situations (typically inside a bag or relatively loose pocket), to slide open in uncontrolled manner, i.e. the inner container slides out of the outer container, thus resulting in cigarette or tobacco fallout from the inner container.

In the case of rigid, swing-open packets of cigarettes, it has been proposed to provide a certain amount of interference between the inner and outer containers when the inner container is in the closed position, so that sufficient pressure must be applied to slightly deform the top corner of the inner container to move it into the open position. In other words, the inner container remains in the closed position until relatively strong pressure is applied to open it. Deformation of the top corner of the inner container, each time the packet is opened, however, has been found to locally damage the cardboard from which the inner container is made, and to compress the cigarettes inside the inner container (thus resulting in 'denting', in particular, of the two cigarettes contacting the top corner).

DESCRIPTION OF THE INVENTION

It is an object of the present invention to provide a slide-open package of tobacco articles, designed to eliminate the above drawbacks, and which in particular is cheap and easy to produce.

According to the present invention, there is provided a slide-open package of tobacco articles, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
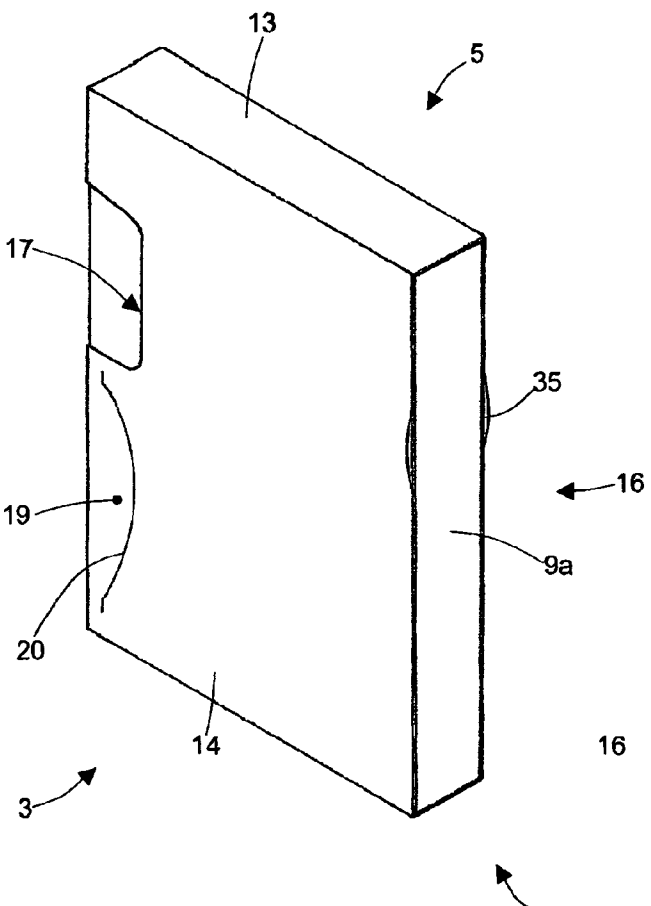
FIG. 1 shows a view in perspective of a rigid, straight slide-open packet of cigarettes in accordance with the present invention and in the closed position.

Number 1 in FIG. 1 indicates as a whole a rigid, straight (linear) slide-open packet of cigarettes.

Packet 1 of cigarettes in FIG. 1 comprises a wrapped group 2 of cigarettes (FIG. 2), i.e. a group (not shown) of cigarettes wrapped in foil packing material; and a rigid outer package 3 made of cardboard or similar and housing the wrapped group 2. Outer package 3 in turn comprises a rigid inner container 4 actually housing the wrapped group 2; and a rigid outer container 5, in which inner container 4 is housed to translate, with respect to outer container 5, between a closed position (FIG. 1), in which inner container 4 is inserted completely inside outer container 5, and an open position (FIG. 2), in which inner container 4 is expelled partly from outer container 5 to allow access to wrapped group 2.

Figure 2:
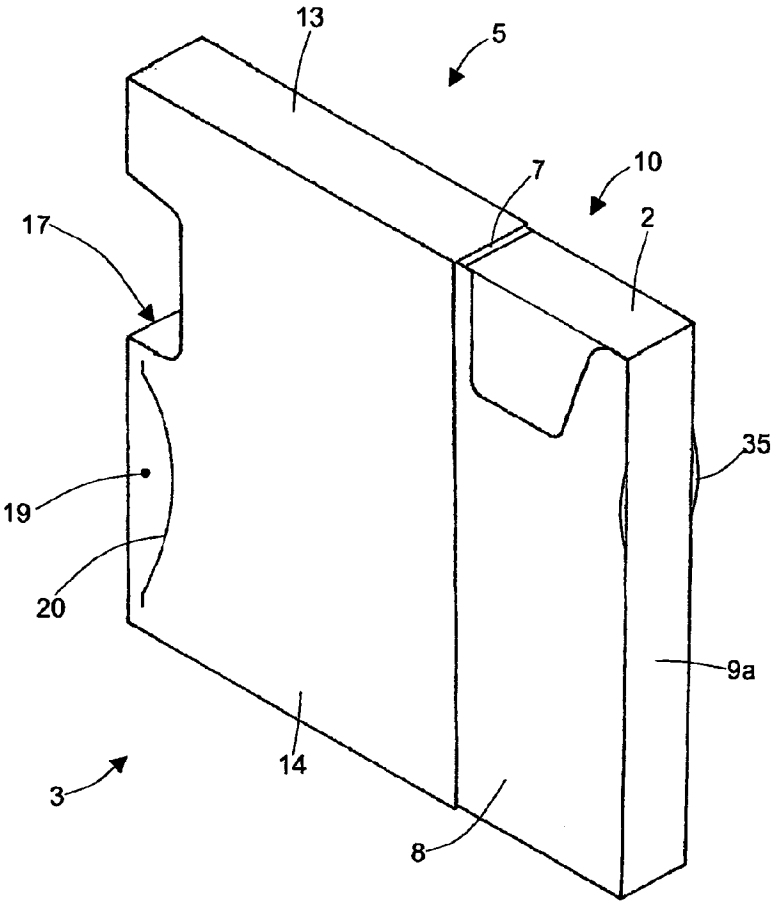
FIG. 2 shows a view in perspective of the FIG. 1 packet of cigarettes in the open position.

As shown in FIG. 2, inner container 4 is parallelepiped-shaped, and comprises a bottom wall 6 (FIG. 4); a top wall 7; two opposite, parallel major lateral walls 8; and two parallel minor lateral walls 9*a*, 9*b* interposed between major lateral walls 8. Close to minor lateral wall 9*a*, top wall 7 has a withdrawal opening 10, which also extends over part of major lateral walls 8, and which, when inner container 4 is in the open position, is located outside outer container 5 to permit withdrawal of the cigarettes (not shown) from inner container 4, after the user first unwraps group 2. Four longitudinal edges are defined between major lateral walls 8 and minor lateral walls 9; and eight transverse edges are defined between lateral walls 8, 9 and walls 6, 7.

Figure 4:
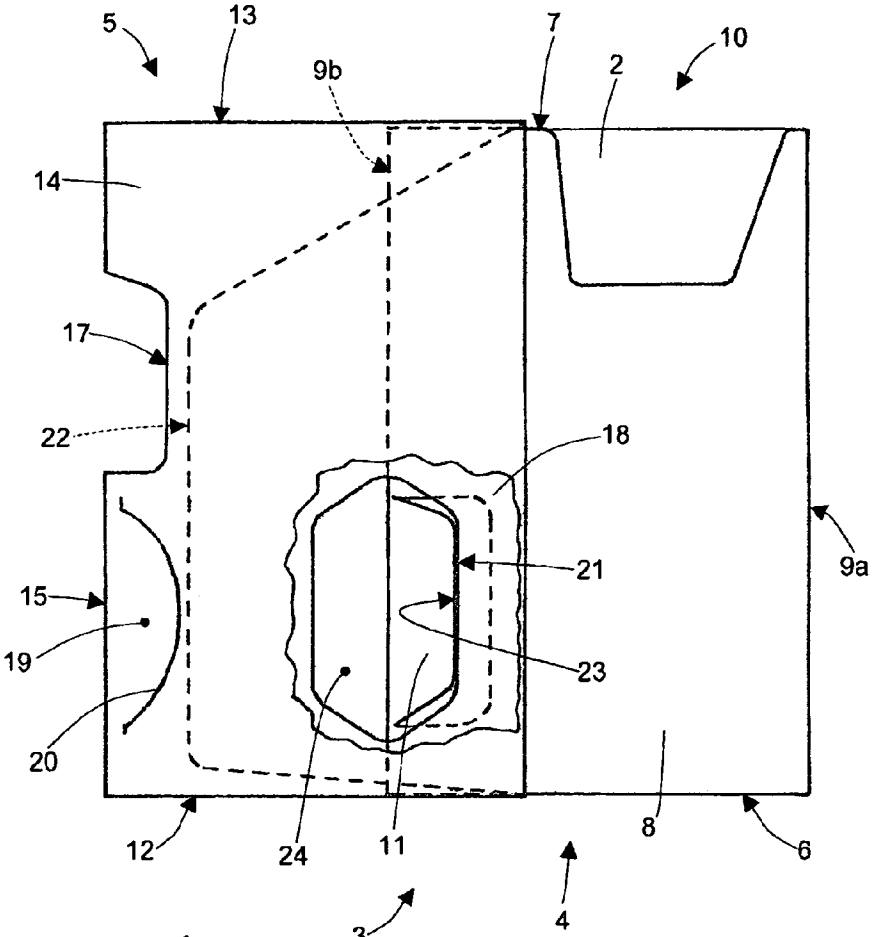
FIGS. 3 and 4 show cutaway side views of the FIG. 1 packet of cigarettes in the closed and open positions respectively.
Figure 3:
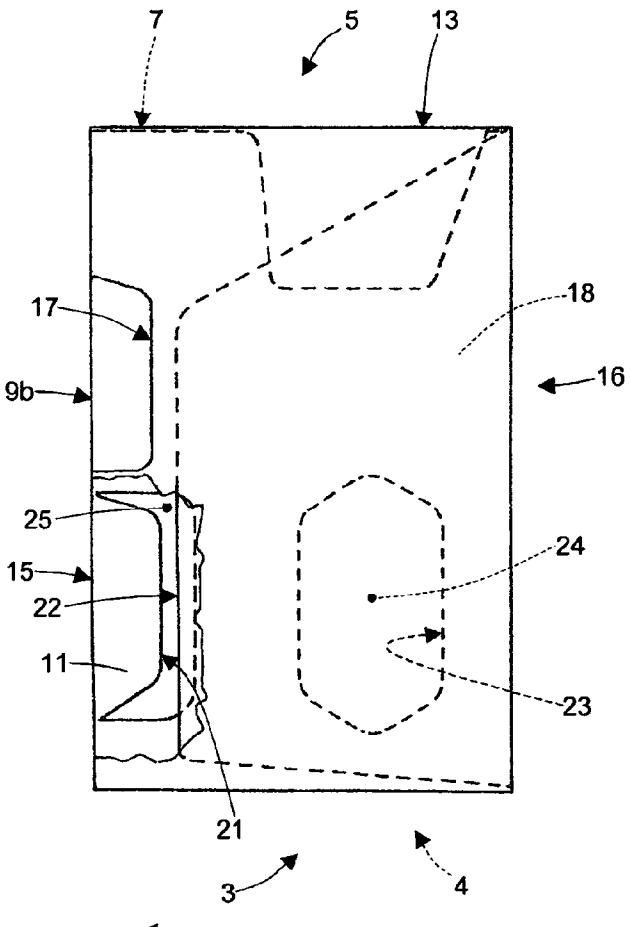

As shown in FIGS. 3 and 4, close to minor lateral wall 9*b*, a lock tab 11 is cut from each major lateral wall 8 and projects outwards of inner container 4 from the edge between major lateral wall 8 and minor lateral wall 9*b*.

As shown in FIG. 1, outer container 5 is also parallelepiped-shaped, and comprises a bottom wall 12 (FIG. 4); a top wall 13; two opposite, parallel major lateral walls 14; a minor lateral wall 15; and an opening 16 opposite minor lateral wall 15 and through which inner container 4 slides. Two longitudinal edges are defined between major lateral walls 14 and minor lateral wall 15; and six transverse edges are defined between lateral walls 14, 15 and walls 12, 13. Minor lateral wall 15 of outer container 5 has a hole 17 shaped and sized to allow the user to exert thrust, through minor lateral wall 15, on minor lateral wall 9*b* of inner container 4, to slide inner container 4 into the open position. In a preferred embodiment shown in the drawings, hole 17 also covers a portion of major lateral walls 14 of outer container 5.

A lock tab 18 is connected to the edge of each major lateral wall 14 of outer container 5 bounding opening 16, and is hinged to, folded 180° onto, and glued to an inner surface of major lateral wall 14. In a different embodiment not shown, as opposed to being hinged to major lateral wall 14 of outer container 5, each lock tab 18 is initially completely separate from major lateral wall 14, and is glued later to the inner surface of major lateral wall 14.

The two lock tabs 11 of inner container 4 and the two lock tabs 18 of outer container 5 form a lock member which, in releasable manner by user action from the outside, prevents inner container 4 in the closed position from sliding with respect to outer container 5. In other words, the lock member comprising the two lock tabs 11 of inner container 4 and the two lock tabs 18 of outer container 5 holds inner container 4 in the closed position by preventing containers 4 and 5 from sliding with respect to each other, and can be disabled by user action from the outside to open packet 1 of cigarettes (i.e. to slide inner container 4, with respect to outer container 5, into the open position).

In nonreleasable manner, the lock member comprising the two lock tabs 11 of inner container 4 and the two lock tabs 18 of outer container 5 also prevents inner container 4 in the open position from sliding with respect to outer container 5, i.e. acts as a limit stop for the withdrawal travel of inner container 4 with respect to outer container 5, to prevent inner container 4 from detaching completely from outer container 5.

In a preferred embodiment shown in the drawings, the lock preventing inner container 4 in the closed position from sliding with respect to outer container 5 can be disabled by exerting pressure on major lateral walls 14 of outer container 5 to press them inwards. More specifically, each major lateral wall 14 of outer container 5 has a deformable portion 19 which, when inner container 4 is in the closed position, is located at the lock member (i.e. close to minor lateral wall 15 of outer container 5), and is pressed inwards to release the lock. Each deformable portion 19 of outer container 5 is defined by a crease line 20 formed on wall 14 of outer container 5 and normally defined by a through cut. In the embodiment shown in the drawings, each crease line 20 is U-shaped, but, in a different embodiment not shown, is straight.

The embodiment shown in the drawings has two symmetrical lock tabs 11 projecting outwards from major lateral walls 8 of inner container 4, and two corresponding lock tabs 18 projecting inwards from major lateral walls 14 of outer container 5. A different embodiment, not shown, has only one lock tab 11 projecting outwards from a major lateral wall 8 of inner container 4, and one corresponding lock tab 18 projecting inwards from a major lateral wall 14 of outer container 5.

Each lock tab 11 has an edge 21, which defines the outline of lock tab 11 and faces opening 16 of outer container 5 (i.e. faces minor lateral wall 9*a* of inner container 4); and each lock tab 18 has an edge 22, which defines the outline of lock tab 18 and faces edge 21 of the corresponding lock tab 11 (i.e. faces minor lateral wall 15 of outer container 5, and minor lateral wall 9*b* of inner container 4). Edge 22 of each lock tab 18 defines a mechanical stop, against which edge 21 jams as inner container 4 in the closed position is extracted.

Each lock tab 18 also has an edge 23, which faces edge 21 of corresponding lock tab 11 (i.e. faces minor lateral wall 15 of outer container 5, and minor lateral wall 9*b* of inner container 4) and defines a mechanical stop, against which edge 21 of the corresponding lock tab 11 jams as inner container 4 in the open position is extracted, so as to act as a limit stop for the travel of inner container 4 with respect to outer container 5, and so prevent inner container 4 from detaching completely from outer container 5. Each lock tab 18 preferably has a central through hole 24 defining edge 23 in lock tab 18.

In a preferred embodiment, each lock tab 11 comprises a portion of a major lateral wall 8 of inner container 4, and is defined by a U-shaped through cut in major lateral wall 8. Each major lateral wall 8 of inner container 4 preferably comprises a through hole 24 surrounding edge 21 of lock tab 11.

Operation of packet 1 of cigarettes in FIGS. 1-4 is shown schematically in the FIG. 5-8 cross sections.

Figure 5:
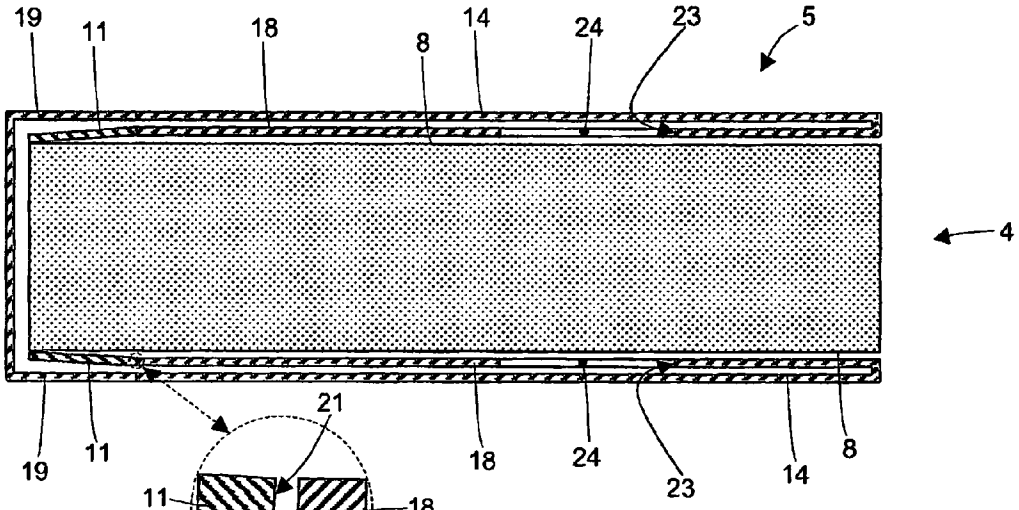
FIGS. 5-8 show cross sections of the FIG. 1 packet of cigarettes illustrating passage from the closed to the open position.

FIG. 5 shows inner container 4 in the closed position, in which lock tabs 11 normally project outwards from major lateral walls 8 of inner container 4, and edges 21 of lock tabs 11 face respective edges 22 of lock tabs 18, which thus act as stops against which edges 21 jam as inner container 4 is extracted.

Figure 6:
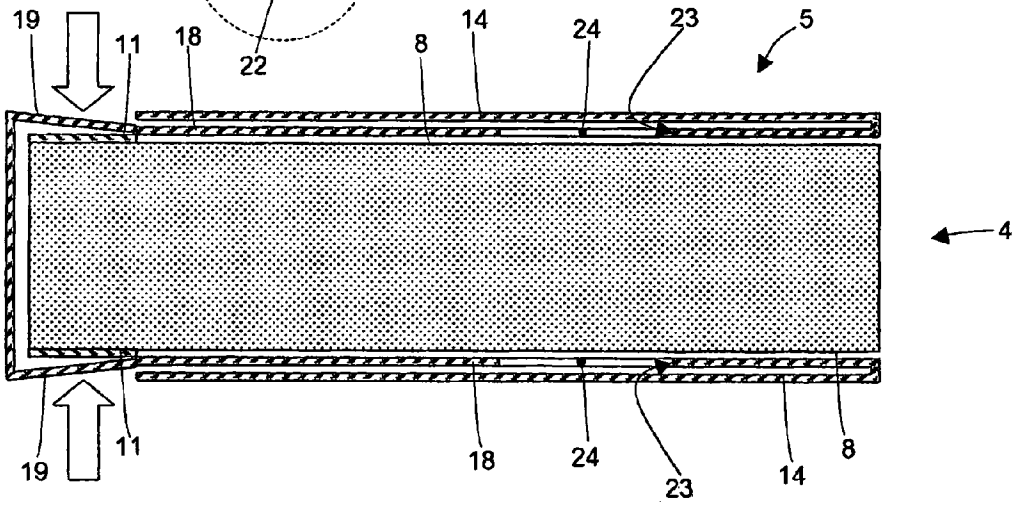
Figure 7:
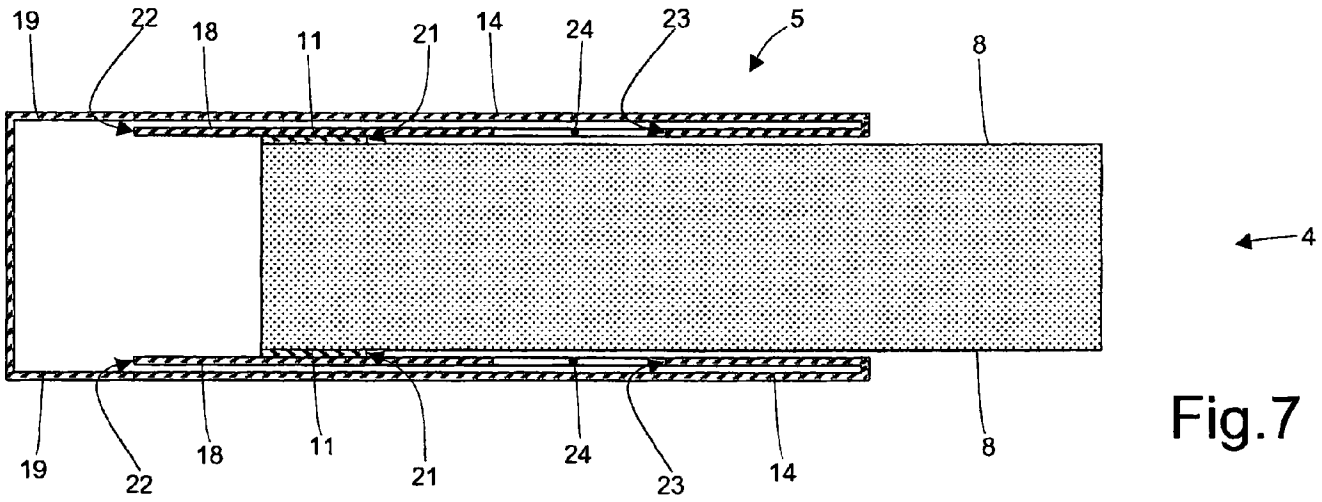

In FIG. 6, inner container 4 is shown in the closed position, and the user presses deformable portions 19 of major lateral walls 14 of outer container inwards to push the two lock tabs 11 flat against inner container 4 and so disengage edges 22 of lock tabs 18. In this configuration, edges 21 of lock tabs 11 no longer jam against edges 22 of lock tabs 18, thus enabling inner container 4 to slide with respect to outer container 4 into the open position, as shown in FIG. 7.

Figure 8:
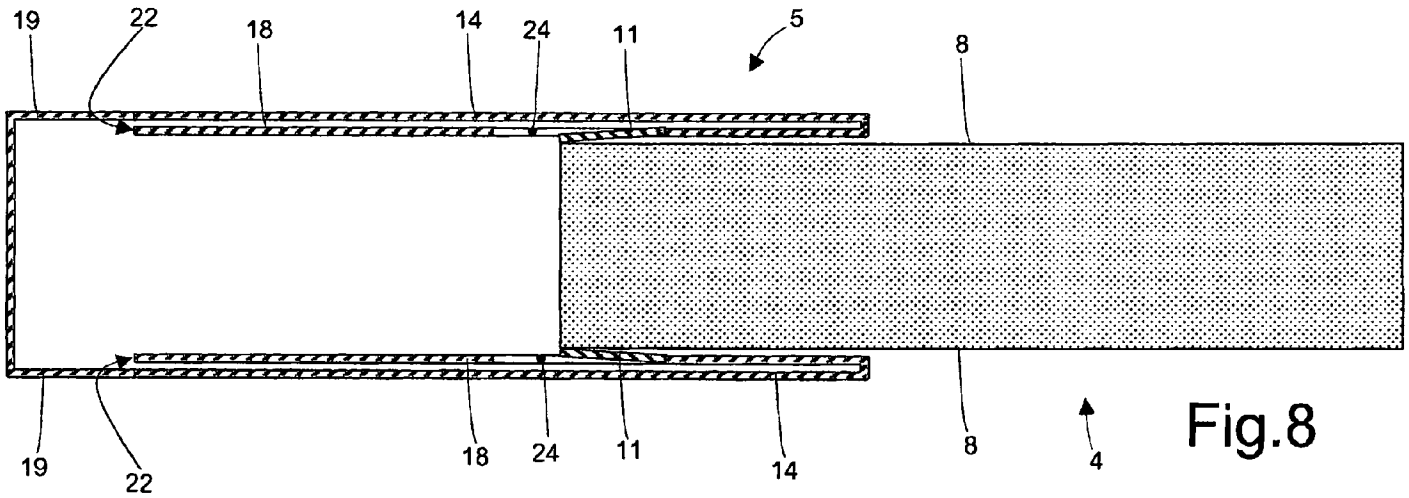

As inner container 4 slides with respect to outer container 5 into the open position, lock tabs 11 of inner container 4 eventually arrive at holes 24, and once more project outwards inside holes 24; and edges 21 of lock tabs 11 eventually come into contact with and so jam against edges 23 (defining holes 24) of lock tabs 18, as shown in FIG. 8. Edges 23 of lock tabs 18 thus act as mechanical stops, against which edges 21 of lock tabs 11 jam as inner container 4 in the open position is extracted, to arrest slide of inner container 4 with respect to outer container 5 and so prevent inner container 4 from detaching completely from outer container 5.

Figure 9:
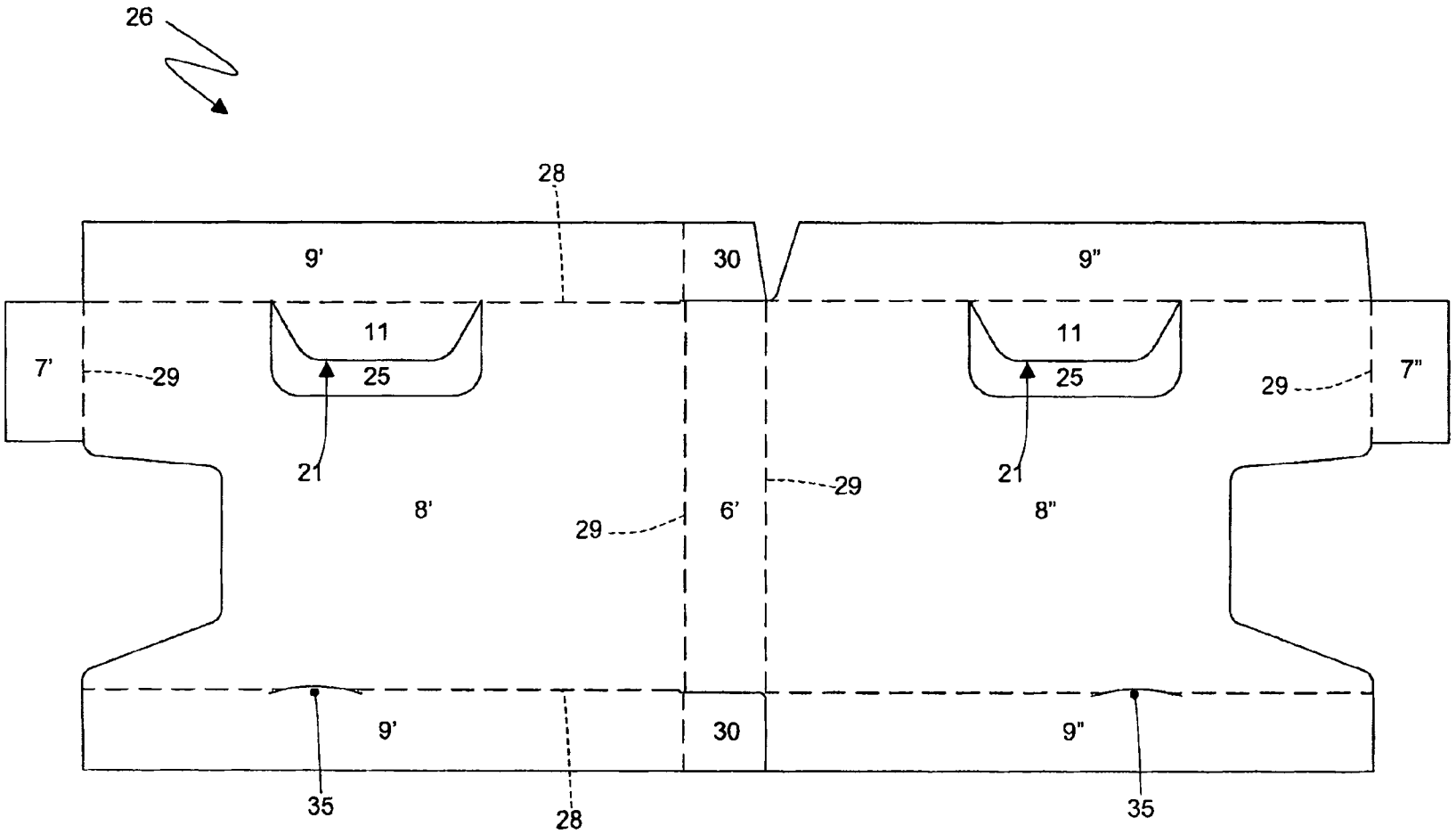
FIG. 9 shows a spread-out plan view of a blank from which to produce an inner container of the FIG. 1 packet of cigarettes.
Figure 10:
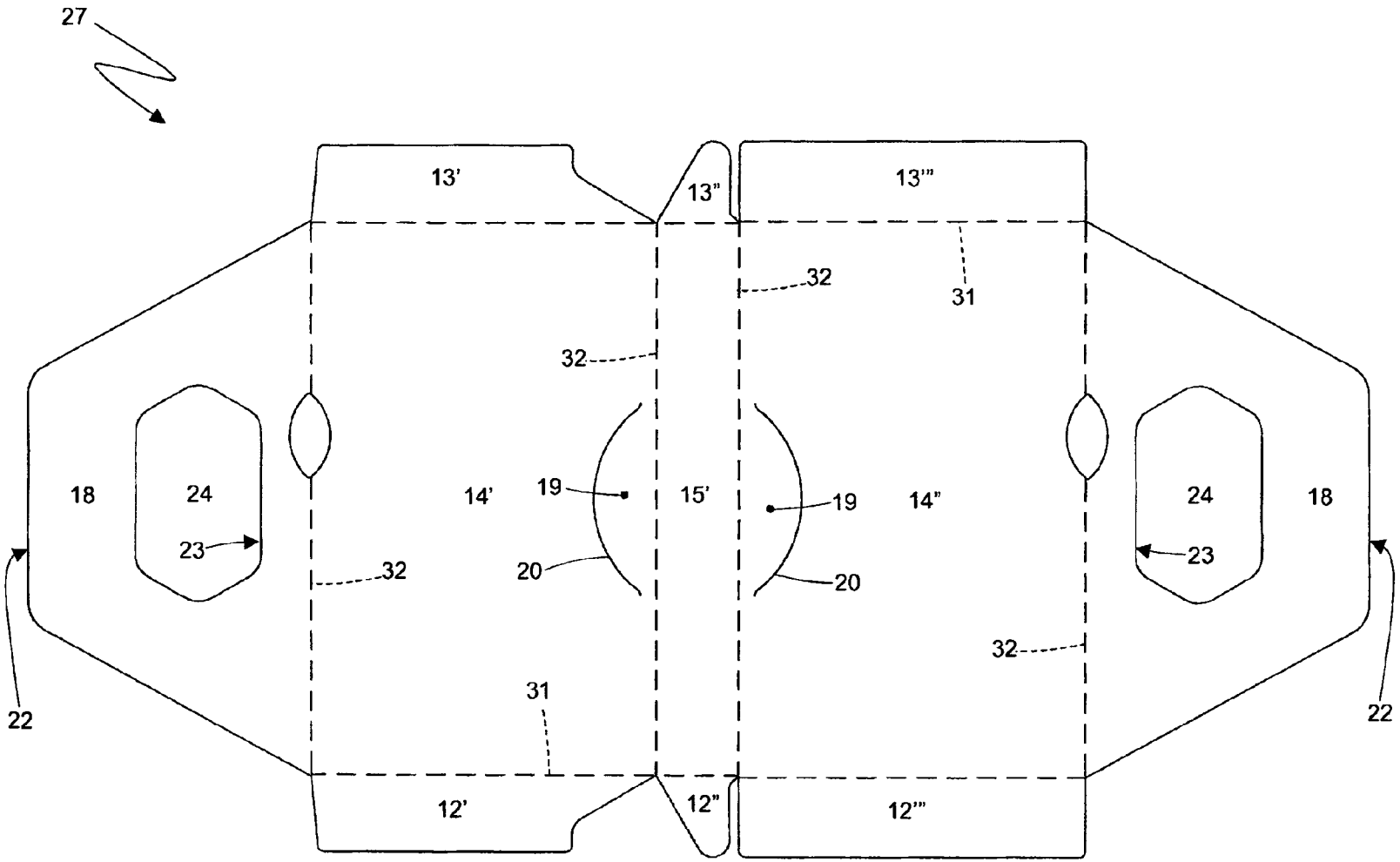
FIG. 10 shows a spread-out plan view of a blank from which to produce an outer container of the FIG. 1 packet of cigarettes.
Figure 12:
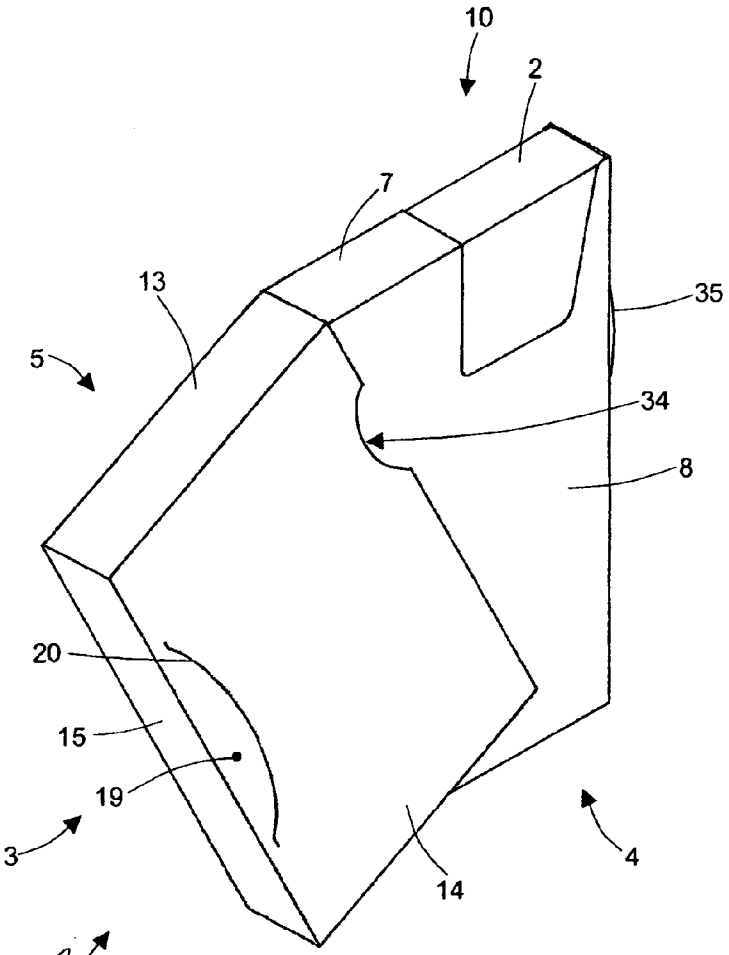
FIG. 12 shows a view in perspective of the FIG. 11 packet of cigarettes in the open position.
Figure 11:
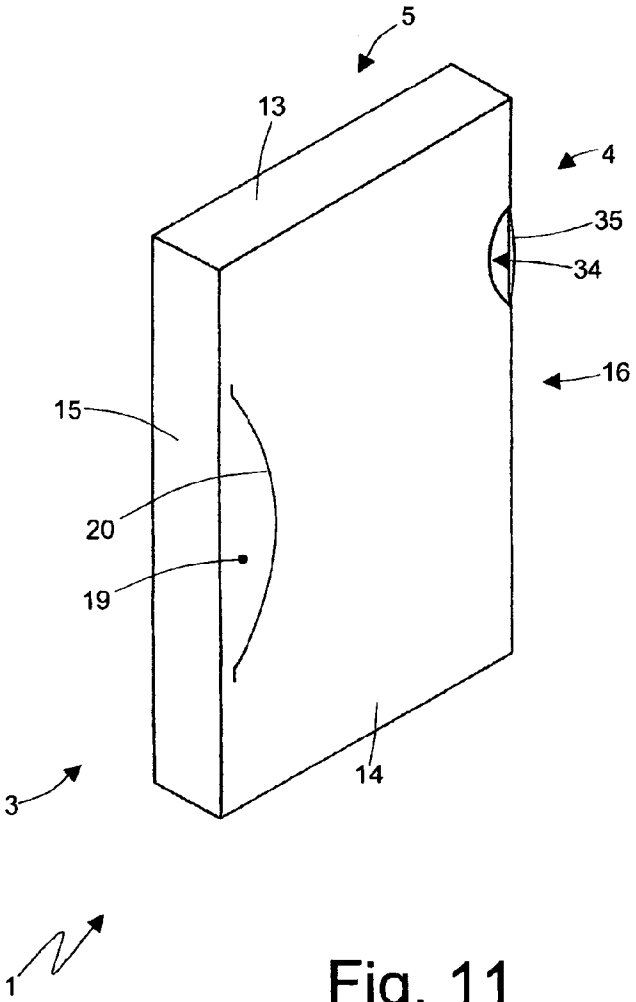
FIG. 11 shows a view in perspective of a rigid, swing-open packet of cigarettes in accordance with the present invention and in the closed position.
Figure 14:
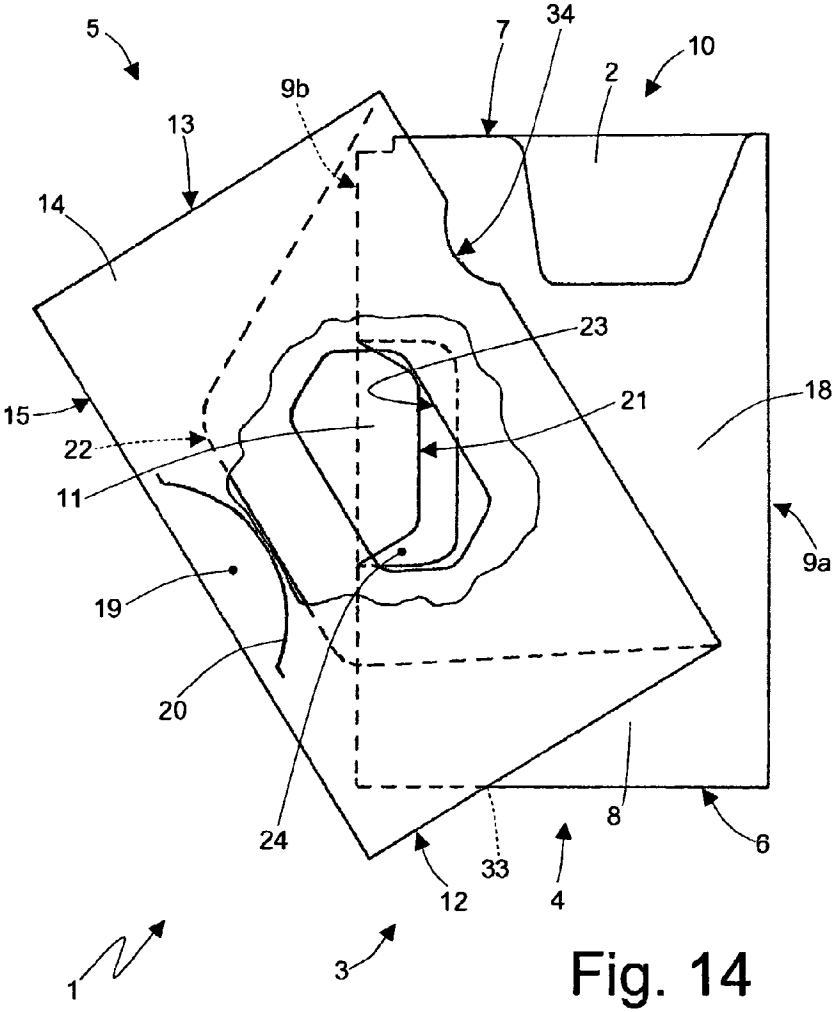
FIGS. 13 and 14 show cutaway side views of the FIG. 11 packet of cigarettes in the closed and open positions respectively.
Figure 13:
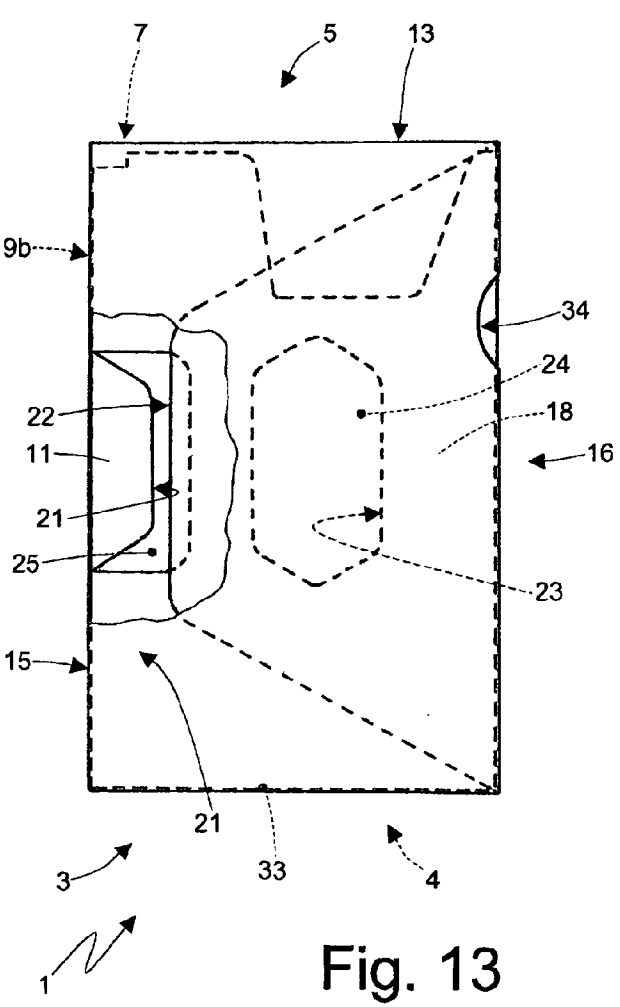

Containers 4 and 5 of packet 1 of cigarettes in FIGS. 1-4 are formed from respective known blanks 26, 27 shown in FIGS. 9 and 10 respectively. Each blank 26, 27 comprises, among other things, a number of panels, which are indicated, whenever possible, using the same reference numbers, with superscripts, as for the corresponding walls of respective container 4, 5.

As shown in FIG. 9, blank 26 comprises two longitudinal fold lines 28, and a number of transverse fold lines 29 which define, between longitudinal fold lines 28, a panel 7' forming part of top wall 7; a panel 8' forming one major lateral wall 8;

a panel 6' forming bottom wall 6; a panel 8" forming the other major lateral wall 8; and a panel 7" forming the rest of top wall 7.

Panel 8' has two lateral wings 9', which form respective outer portions of minor lateral walls 9, are located on opposite sides of panel 8', and are separated from panel 8' by longitudinal fold lines 28. Panel 8" has two lateral wings 9", which form respective inner portions of minor lateral walls 9, are located on opposite sides of panel 8", and are separated from panel 8" by longitudinal fold lines 28. Lateral wings 9' of panel 8' have two tabs 30, each separated from relative lateral wing 9' by a transverse fold line 29. And a respective lock tab 11, partly surrounded by a corresponding hole 25, is formed in each panel 8', 8".

As shown in FIG. 10, blank 27 has two transverse fold lines 31, and a number of longitudinal fold lines 32 which define, between transverse fold lines 31, a panel 14' forming one major lateral wall 14; a panel 15' forming minor lateral wall 15; and a panel 14" forming the other major lateral wall 14. Each panel 14', 14" has a lock tab 18 located on the opposite side to panel 15' and separated from respective panel 14', 14" by a longitudinal fold line 32.

Panel 14' has two trapezoidal end wings 12', 13', which are located at opposite ends of panel 14', are separated from panel 14' by transverse fold lines 31, and form respective inner portions of walls 12 and 13. Panel 15' has two end wings 12", 13", which are located at opposite ends of panel 15', are separated from panel 15' by transverse fold lines 31, are triangular in shape with a rounded outer vertex, and form respective inner portions of walls 12 and 13. Panel 14" has two rectangular end wings 12''', 13''', which are located at opposite ends of panel 14", are separated from panel 14" by transverse fold lines 31, and form respective outer portions of walls 12 and 13. And end wings 12', 12" and 13', 13" are shaped so as not to overlap when folded onto end wings 12''' and 13''' to form walls 12 and 13 of outer container 5.

In the FIG. 1-4 embodiment, packet 1 of cigarettes slides straight open, i.e. inner container 4 translates with respect to outer container 5 between the open and closed positions (i.e. moves linearly in a direction parallel to the major transverse edges). In the FIG. 11-14 embodiment, packet 1 of cigarettes swings open, i.e. inner container 4 moves with respect to outer container 5 between the open and closed positions by rotating about a hinge 33 connecting bottom wall 6 of inner container 4 to bottom wall 12 of outer container 5.

In other words, the FIG. 1-4 and FIG. 11-14 packets 1 of cigarettes differ by inner container 4 of the FIG. 11-14 packet 1 of cigarettes being hinged (i.e. connected) to outer container 5 by hinge 33, whereas inner container 4 of the FIG. 1-4 packet 1 of cigarettes is simply inserted inside outer container 5, with no connection of any kind between the two containers 4 and 5. As such, containers 4 and 5 of the FIG. 11-14 packet 1 of cigarettes slide by rotating about hinge 33, whereas, in the FIG. 1-4 packet 1 of cigarettes, they slide linearly.

Another difference between the FIG. 1-4 and FIG. 11-14 packets 1 of cigarettes lies in the FIG. 1-4 packet 1 of cigarettes having hole 17 formed substantially through minor lateral wall 15 of outer container 5, whereas, in the FIG. 11-14 packet 1 of cigarettes, hole 17 is eliminated and its function (of facilitating relative movement between containers 4 and 5) is performed by two holes 34 formed symmetrically on opposite sides of major lateral walls 14 of outer container 5, at opening 16.

By maintaining inner container 4 in the closed position by means of the lock member, no interference is necessary between inner container 4 in the closed position and outer container 5. The top corner of inner container 4 is therefore in no way deformed to move inner container 4 into the open position, thus avoiding any damage to the cardboard of inner container 4 or to the cigarettes inside inner container 4.

Figure 15:
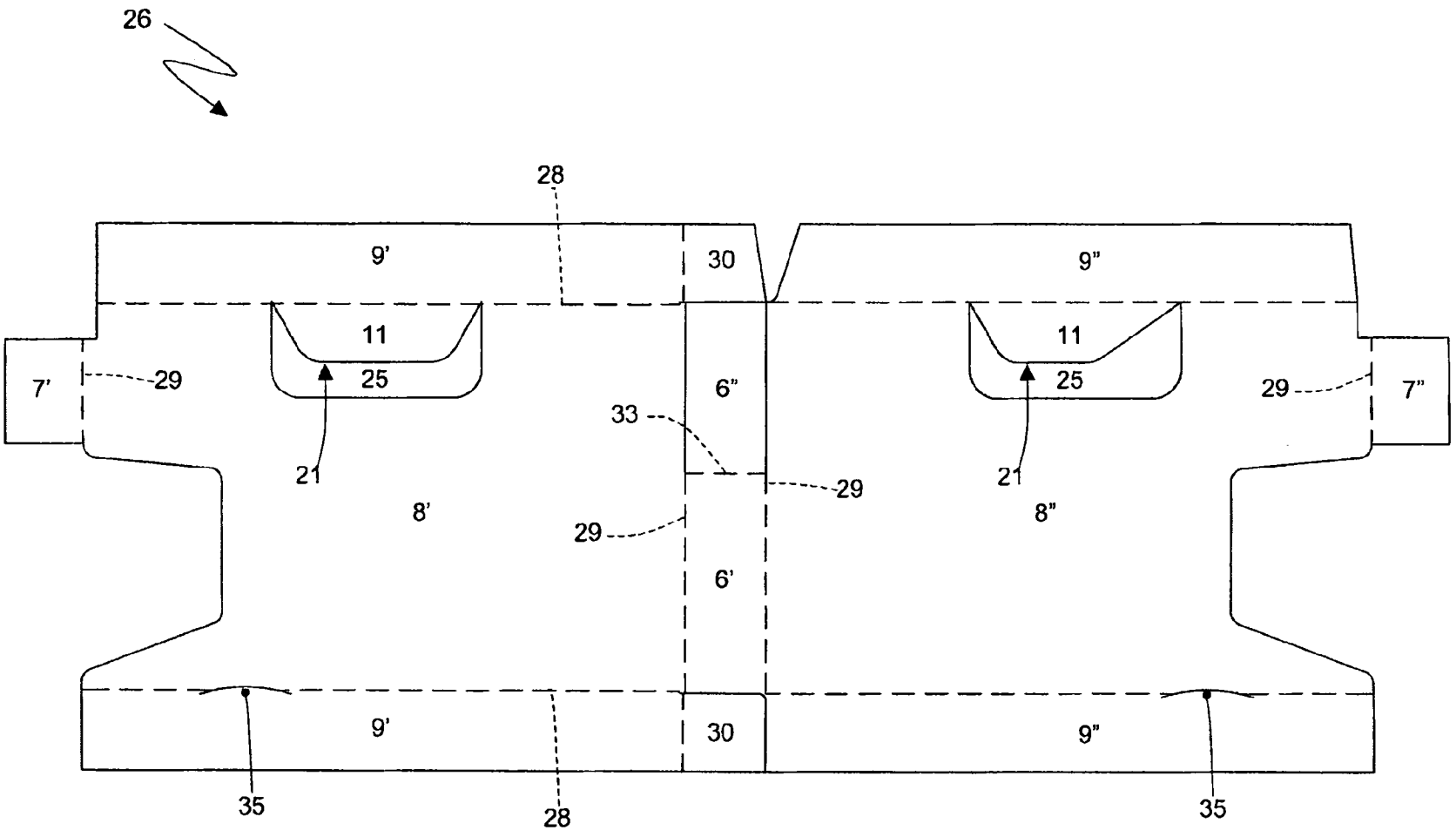
FIG. 15 shows a spread-out plan view of a blank from which to produce an inner container of the FIG. 11 packet of cigarettes.

In one possible embodiment shown in FIGS. 1, 2, 11 and 12, minor lateral wall **9*a* of inner container 4 has two projections 35 projecting parallel to minor lateral wall 9*a* (therefore perpendicularly to the two major lateral walls 8) from the two longitudinal edges of minor lateral wall 9*a*, and which serve to facilitate grip of inner container 4 by the user. As shown in FIGS. 9 and 15, projections 35 are formed by respective through cuts in panels 8' and 8" of blank 26; and, when panels 9' and 9" are folded 90° with respect to corresponding panels 8' and 8", projections 35 fold 90° together with panels 9' and 9" and with respect to corresponding panels 8' and 8", and so remain coplanar with and project laterally from panels 9' and 9" (i.e. from the minor lateral wall 9*a* of inner container 4 formed by superimposing panels 9' and 9"**).

Figure 16:
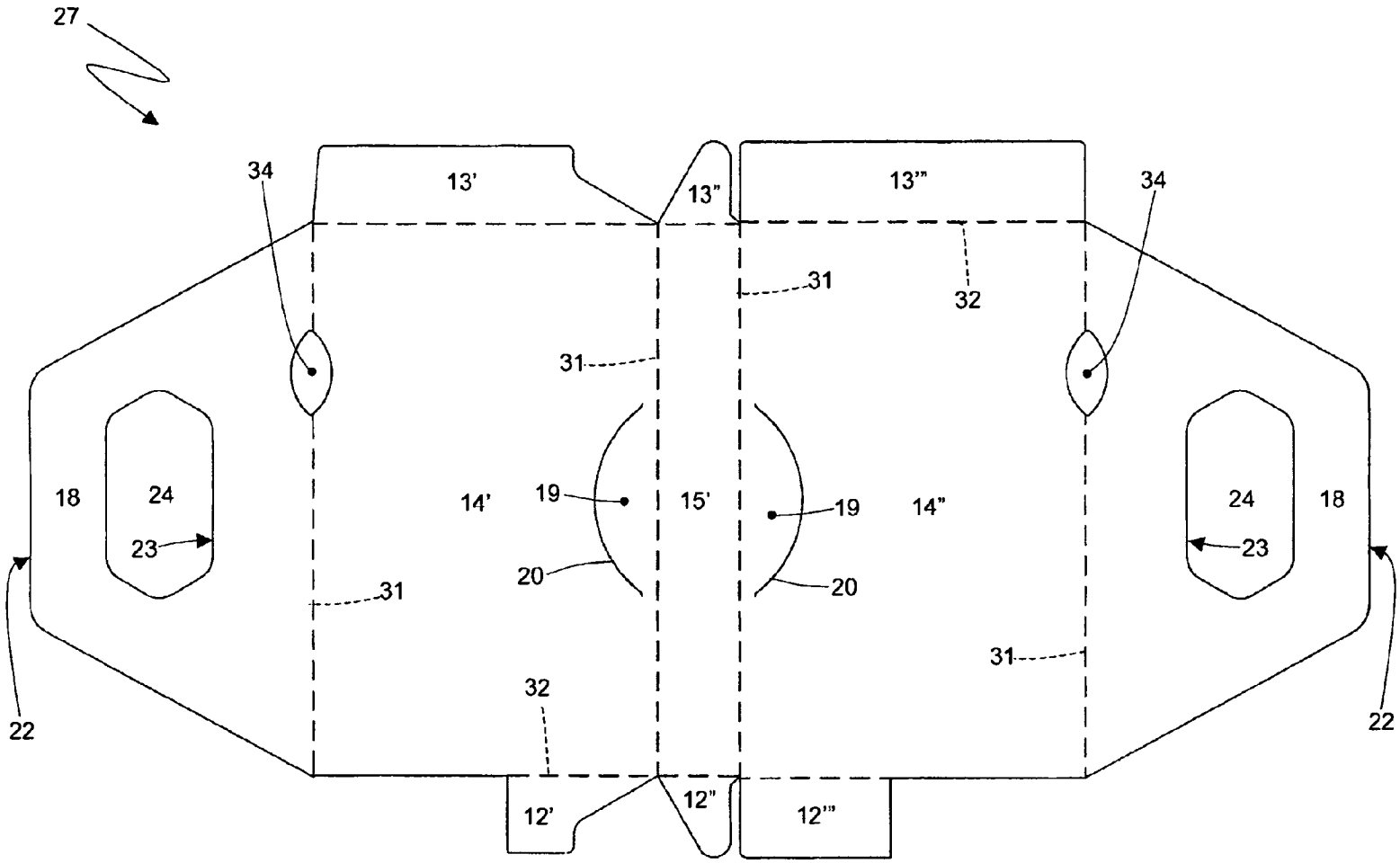
FIG. 16 shows a spread-out plan view of a blank from which to produce an outer container of the FIG. 11 packet of cigarettes.

Containers 4 and 5 of the FIG. 11-14 packet 1 of cigarettes are formed from respective blanks 26 and 27 shown in FIGS. 15 and 16, and which are identical to the FIGS. 9 and 10 blanks 26 and 27 used to form containers 4 and 5 of the FIG. 1-4 packet 1 of cigarettes.

Packet 1 of cigarettes described has numerous advantages: it is cheap and easy to produce and, above all, features a lock member which, in releasable manner by user action from the outside, prevents inner container 4 in the closed position from sliding with respect to outer container 5, thus preventing packet 1 of cigarettes from opening inadvertently. Moreover, the lock member also acts as a 'child safety' device by requiring combined, two-handed user action to open packet 1 of cigarettes (one hand to exert pressure on deformable portions 19 of major lateral walls 14 of outer container 5, and the other hand to withdraw inner container 4 from outer container 5). Though simple enough for an adult, this combined action of both hands is much more complicated for a child, thus making packet 1 of cigarettes easy to open by an adult, but difficult to open by a child.

In view of its numerous advantages, the design of packet 1 of cigarettes described may also be applied to the manufacture of a carton of cigarettes, which is substantially similar to packet 1 of cigarettes, the only difference being that it contains a group of packets of cigarettes as opposed to a group of cigarettes.

The invention claimed is:

1. A package of tobacco articles, comprising:

an inner container (4) containing a group (2) of tobacco articles;

an outer container (5) which houses the inner container (4) in such a manner as to allow the inner container (4) to slide, with respect to the outer container (5), between a closed position, in which the inner container (4) is inserted inside the outer container (5), and an open position, in which the inner container (4) is partly extracted from the outer container (5); and at least one lock member which, in releasable manner by user action from the outside, prevents the inner container (4) in the closed position from sliding with respect to the outer container (5);

wherein the lock member preventing the inner container (4) in the closed position from sliding with respect to the outer container (5) is releasable by exerting pressure on a wall (14) of the outer container (5) to press the wall (14) inwards; and wherein the lock member, in non-releasable manner, also prevent the inner container (4) in the open position from sliding with respect to the outer container (5).

2. A package as claimed in claim 1, wherein the wall (14) of the outer container (5) comprises a deformable portion (19) which, when the inner container (4) is in the closed position, is located at the lock member, and is pressed inwards to release the lock member.

3. A package as claimed in claim 2, wherein the deformable portion (19) of the outer container (5) is defined by a crease line (20) formed in the wall (14) of the outer container (5).

4. A package as claimed in claim 3, wherein the crease line (20) is U-shaped.

5. A package as claimed in claim 3, wherein the crease line (20) is straight.

6. A package as claimed in claim 3 wherein the crease line (20) is defined by a through cut.

7. A package as claimed in claim 1, wherein the lock member comprises:

at least one first lock tab (11) which normally projects outwards from a wall (8) of the inner container (4), and has a first edge (21); and a second lock tab (18) which projects inwards from a wall (14) of the outer container (5), and has a second edge (22) facing the first edge (21) of the first lock tab (11), and which defines a mechanical stop against which the first edge (21) jams as the inner container (4) in the closed position is extracted.

8. A package as claimed in claim 7, wherein the lock member comprises a third edge (23) facing the first edge (21) of the first lock tab (11), and defining a mechanical stop, against which the first edge (21) jams as the inner container (4) in the open position is extracted, and which acts as a limit stop to limit slide of the inner container (4) with respect to the outer container (5) and prevent the inner container (4) from detaching completely from the outer container (5).

9. A package as claimed in claim 8, wherein the second lock tab (18) has a central first through hole (24) defining the third edge (23) in the second lock tab (18).

10. A package as claimed in claim 7 wherein the first lock tab (11) is defined by a portion of a major lateral wall (8) of the inner container (4), and is bounded by a through cut through the major lateral wall (8).

11. A package as claimed in claim 10, wherein the major lateral wall (8) of the inner container (4) comprises a second through hole (25) surrounding the first edge (21) of the first lock tab (11).

12. A package as claimed in claim 7, wherein the second lock tab (18) is glued to an inner surface of a major lateral wall (14) of the outer container (5).

13. A package as claimed in claim 12, wherein the second lock tab (18) is hinged to and folded 180° onto the major lateral wall (14) of the outer container (5).

14. A package as claimed in claim 1, wherein a minor lateral wall (9*a*) of the inner container (4), facing outwards from an opening (16), comprises two projections (35), which project, parallel to the minor lateral wall (9*a*), from two longitudinal edges defining the minor lateral wall (9*a*), and provide for easy grip of the inner container (4) by the user.

15. A package as claimed in claim 14, wherein the inner container (4) is formed by folding a blank (26) having two first panels (8', 8") which form the major lateral walls (8), and have respective lateral wings (9', 9") which form the minor lateral walls (9); the two projections (35) being formed by respective through cuts in the first panels (8', 8") of the blank (26).

16. A package of tobacco articles, comprising:

an inner container (4) containing a group (2) of tobacco articles;

an outer container (5) which houses the inner container (4) in such a manner as to allow the inner container (4) to slide, with respect to the outer container (5), between a closed position, in which the inner container (4) is inserted inside the outer container (5), and an open position, in which the inner container (4) is partly extracted from the outer container (5); and at least one lock member which, in releasable manner by user action from the outside, prevents the inner container (4) in the closed position from sliding with respect to the outer container (5);

wherein the lock member preventing the inner container (4) in the closed position from sliding with respect to the outer container (5) is releasable by exerting pressure on a wall (14) of the outer container (5) to press the wall (14) inwards;

wherein the lock member comprises: at least one first lock tab (11) which normally projects outwards from a wall (8) of the inner container (4), and has a first edge (21); and a second lock tab (18) which projects inwards from a wall (14) of the outer container (5), and has a second edge (22) facing the first edge (21) of the first lock tab (11), and which defines a mechanical stop against which the first edge (21) jams as the inner container (4) in the closed position is extracted; and wherein the lock member comprises a third edge (23) facing the first edge (21) of the first lock tab (11), and defining a mechanical stop, against which the first edge (21) jams as the inner container (4) in the open position is extracted, and which acts as a limit stop to limit slide of the inner container (4) with respect to the outer container (5) and prevent the inner container (4) from detaching completely from the outer container (5).

17. A package as claimed in claim 16, wherein the second lock tab (18) has a central first through hole (24) defining the third edge (23) in the second lock tab (18).

18. A package of tobacco articles, comprising:

an inner container (4) containing a group (2) of tobacco articles;

an outer container (5) which houses the inner container (4) in such a manner as to allow the inner container (4) to slide, with respect to the outer container (5), between a closed position, in which the inner container (4) is inserted inside the outer container (5), and an open position, in which the inner container (4) is partly extracted from the outer container (5); and at least one lock member which, in releasable manner by user action from the outside, prevents the inner container (4) in the closed position from sliding with respect to the outer container (5);

wherein the lock member preventing the inner container (4) in the closed position from sliding with respect to the outer container (5) is releasable by exerting pressure on a wall (14) of the outer container (5) to press the wall (14) inwards;

wherein the lock member comprises: at least one first lock tab (11) which normally projects outwards from a wall (8) of the inner container (4), and has a first edge (21); and a second lock tab (18) which projects inwards from a wall (14) of the outer container (5), and has a second edge (22) facing the first edge (21) of the first lock tab (11), and which defines a mechanical stop against which the first edge (21) jams as the inner container (4) in the closed position is extracted; and wherein the second lock tab (18) is glued to an inner surface of a major lateral wall (14) of the outer container (5).

19. A package as claimed in claim 18, wherein the second lock tab (18) is hinged to and folded 180.degree. onto the major lateral wall (14) of the outer container (5).

20. A package of tobacco articles, comprising:

an inner container (4) containing a group (2) of tobacco articles;

an outer container (5) which houses the inner container (4) in such a manner as to allow the inner container (4) to slide, with respect to the outer container (5), between a closed position, in which the inner container (4) is inserted inside the outer container (5), and an open position, in which the inner container (4) is partly extracted from the outer container (5); and at least one lock member which, in releasable manner by user action from the outside, prevents the inner container (4) in the closed position from sliding with respect to the outer container (5);

wherein the lock member preventing the inner container (4) in the closed position from sliding with respect to the outer container (5) is releasable by exerting pressure on a wall (14) of the outer container (5) to press the wall (14) inwards; and wherein a minor lateral wall (9*a*) of the inner container (4), facing outwards from an opening (16), comprises two projections (35), which project, parallel to the minor lateral wall (9*a*), from two longitudinal edges defining the minor lateral wall (9*a*), and provide for easy grip of the inner container (4) by the user.

21. A package as claimed in claim 20, wherein the inner container (4) is formed by folding a blank (26) having two first panels (8', 8") which form the major lateral walls (8), and have respective lateral wings (9', 9") which form the minor lateral walls (9); the two projections (35) being formed by respective through cuts in the first panels (8', 8") of the blank (26).

* * * * *